US006242168B1

(12) United States Patent
Avidano et al.

(10) Patent No.: US 6,242,168 B1
(45) Date of Patent: Jun. 5, 2001

(54) SILVER HALIDE COLOR PHOTOGRAPHIC LIGHT-SENSITIVE ELEMENTS HAVING IMPROVED IMAGE QUALITY

(75) Inventors: Mauro Avidano, Asti; Raffaella Biavasco, Savona; Diego Brignone, Rocchetta di Cairo; Giuseppe Rocca, Carcare; Luisa Tavella, Bergeggi, all of (IT)

(73) Assignee: Ferrania SpA, Savona (IT)

( * ) Notice: Subject to any disclaimer, the term of this patent is extended or adjusted under 35 U.S.C. 154(b) by 0 days.

(21) Appl. No.: 09/576,528

(22) Filed: May 23, 2000

(30) Foreign Application Priority Data

May 25, 1999 (EP) ..... 99110137

(51) Int. Cl.[7] ..... G03C 1/46

(52) U.S. Cl. ..... 430/505; 430/506; 430/567; 430/544; 430/557; 430/957

(58) Field of Search ..... 430/505, 544, 430/557, 957, 506, 567, 955

(56) References Cited

U.S. PATENT DOCUMENTS

| | | | | |
|---|---|---|---|---|
| 4,833,070 | * | 5/1989 | Kunitz et al. | 430/505 |
| 4,840,880 | * | 6/1989 | Ohlschlager et al. | 430/505 |
| 5,006,452 | | 4/1991 | Bucci . | |
| 5,314,792 | | 5/1994 | Merrill . | |
| 5,332,656 | * | 7/1994 | Bertoldi et al. | 430/544 |
| 5,496,692 | * | 3/1996 | Bertoldi et al. | 430/544 |
| 5,736,307 | * | 4/1998 | Bertoldi et al. | 430/505 |
| 5,780,216 | * | 7/1998 | Ihama | 430/567 |

FOREIGN PATENT DOCUMENTS

| | | |
|---|---|---|
| 0432834 | 5/1996 | (EP) . |
| 0887703 | 12/1998 | (EP) . |
| 0747763 | 10/1999 | (EP) . |
| 0476327 | 11/1999 | (EP) . |

OTHER PUBLICATIONS

European Search Report of application No. EP99110137, which sites patents pertinent to the above–mentioned application.

Certificate of Correction for Patent No. 5,006,452: Dated Apr. 9, 1991: Inventors: Marco Bucci.

Certificate of Correction for Patent No. 5,332,656: Dated Jul. 26, 1994: Inventors: Bertoldi et al.

* cited by examiner

*Primary Examiner*—Geraldine Letscher
(74) *Attorney, Agent, or Firm*—Mark A. Litman & Assoc.; Mark A. Litman

(57) ABSTRACT

The present invention relates to a light-sensitive silver halide color multilayer photographic material which comprises a support base having coated thereon at least three red-sensitive emulsion layers having different sensitivity, at least three green-sensitive emulsion layers having different sensitivity, and at least two yellow-sensitive emulsion layers having different sensitivity, wherein (a) a core-shell silver halide emulsion having an average silver iodide content lower than 10% mol is present in at least one of the lowest sensitive red-, green- and yellow layers, (b) a yellow dye forming malonodiamide DIR coupler having in the coupling position thereof a 4,7-dihalogen-2-benzotriazolyl group is present in both the medium sensitive red- and green-sensitive layers, and (c) a yellow dye forming DIR coupler having a 1,2,4-triazolyl group attached to the coupling position, such 1,2,4-triazolyl group comprising a hydrolizable alkoxy- or aryloxy-carbonyl group attached to a benzytlthio substituent on the 1,2,4-triazolyl group is present in at least one of the highest sensitive red- and green-sensitive layers.

5 Claims, 2 Drawing Sheets

Figure 1:
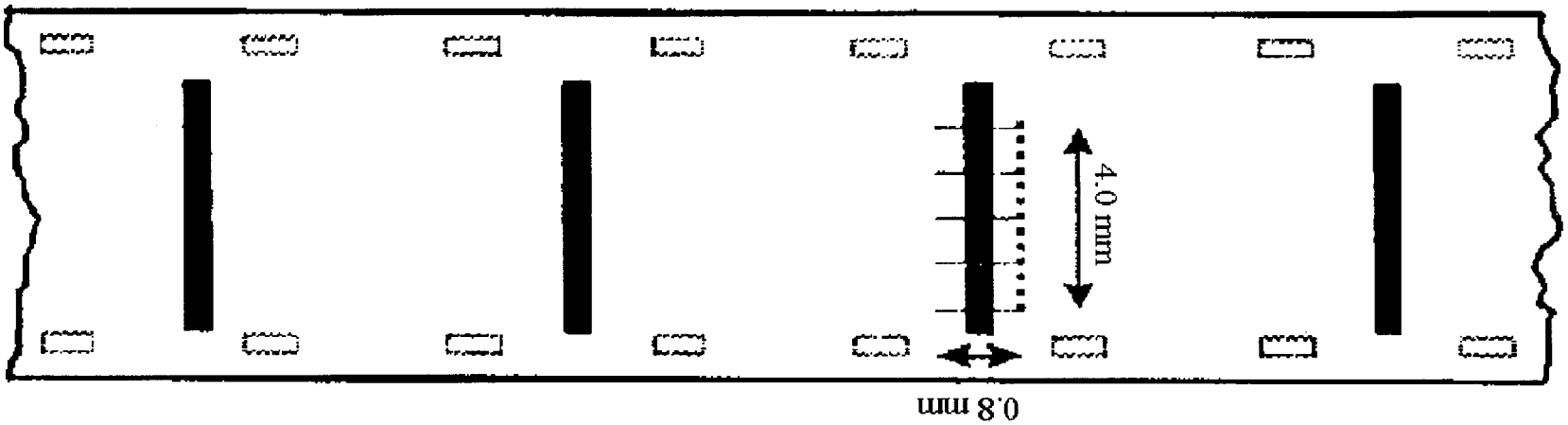

SILVER HALIDE COLOR PHOTOGRAPHIC LIGHT-SENSITIVE ELEMENTS HAVING IMPROVED IMAGE QUALITY

FIELD OF THE INVENTION

The present invention relates to a light-sensitive silver halide color photographic multilayer material, comprising a combination of a core-shell silver halide emulsion and two different yellow dye forming DIR (Development Inhibitor Releasing) couplers capable of releasing a development inhibiting compound upon reaction with the developing agent oxidation product.

BACKGROUND OF THE INVENTION

It is well known that color photographic light-sensitive elements, using the subtractive process for color reproduction, comprise silver halide emulsion layers selectively sensitive to blue, green and red light and associated with yellow, magenta and cyan dye-forming couplers which form (upon reaction with an oxidized primary amine type color developing agent) the complementary color thereof. For example, an acylacetanilide type coupler is used to form a yellow color image; a pyrazolone, pyrazolotriazole, cyanacetophenone or indazolone type coupler is used to form a magenta color image; and a phenol type, such as a phenol or naphthol, coupler is used to form a cyan color image.

Usually, the color photographic light-sensitive elements comprise non-diffusible couplers incorporated independently in each of the light-sensitive layers of the material (incorporated coupler materials). Therefore, a color photographic light-sensitive element usually comprises a blue-sensitive silver halide emulsion layer (or layers) which contains a yellow dye-forming coupler and which is mainly sensitive to blue light (substantially to wavelengths less than about 500 nm), a green-sensitive silver halide emulsion layer (or layers) which contains a magenta dye-forming coupler and which is mainly sensitive to green light (substantially to wavelengths of about 500 to 600 nm) and a red-sensitive silver halide emulsion layer (or layers) which contains a cyan dye-forming coupler and which is mainly sensitive to red light (substantially to wavelengths longer than about 590 nm).

It is also known to incorporate into a light-sensitive color photographic material a compound capable of releasing a development inhibitor during development upon reaction with the oxidation product of a color developing agent. Typical examples of said compounds are the DIR (Development Inhibitor Releasing) couplers containing a group having a development inhibiting property when released from the coupler. This group is introduced at the coupling position of the coupler. Examples of DIR couplers are described by in U.S. Pat. Nos. 3,227,554, 3,615,506, 3,617,291, 3,701,783, 3,933,500 and 4,149,886.

U.S. Pat. No. 4,833,070 and U.S. Pat. No. 4,840,880 disclose that remarkably high interimage and Eberhard effects are obtained when yellow DIR couplers having a specific formula are added to multilayered color photographic recording materials, in particular to the green-sensitive or red-sensitive layers. These couplers can improve the sharpness and color reproduction.

U.S. Pat. No. 5,314,792 discloses a photographic element comprising at least two light sensitive silver halide layers sensitized to green light and having differing degrees of light sensitivity, comprising in association with a higher sensitivity layer a yellow dye forming DIR coupler which releases a development inhibitor containing a weak inhibitor fragment, and further comprising in association with the lower sensitivity layer a cyan dye forming DIR coupler with a timing group containing a strong inhibitor fragment which releases a precursor of the development inhibitor fragment. Such a layer arrangement provides the ability to inhibit the red- and the blue-sensitive layers to the desired degree as a function of the green-sensitive layer development and thereby provides improved color rendition.

U.S. Pat. No. 5,006,452 describes a color photographic material containing a DIR coupler having a 4,7-dihalogen-2-benzotriazolyl type group which is released during development upon oxidation with a developer agent. U.S. Pat. No. 5,332,656 describes a color photographic material containing the combination of a) a yellow dye forming diketomethylene coupler in its active coupling position having a 4,7-dihalogen-2-benzotriazolyl group which provides a compound having development inhibiting properties when the group is released from the active coupling position upon color development reaction, and b) a yellow dye forming alkoxybenzoyl-acetanilide coupler having a releasable 3-hydantoine group linked to the active coupling position.

EP 887,703 discloses a light-sensitive silver halide color photographic multilayer material which comprises a supporting base having coated thereon at least one blue light-sensitive silver halide emulsion layer, associated with yellow dye forming couplers, containing a) a yellow dye forming DIR coupler having a 1,2,4-triazolyl group attached to the coupling position thereof, from which the 1,2,4-triazolyl group is released during development, such 1,2,4-triazolyl group comprising a hydrolizable alkoxy- or aryloxy-carbonyl group attached to a benzylthio substituent on the 1,2,4-triazolyl group and b) a yellow dye forming malonodiamide DIR coupler having, in the coupling position thereof, a 4,7-dihalogen-2-benzotriazolyl group which gives a compound having development inhibiting properties when the group is released from the coupling position during development. Said light-sensitive silver halide color material containing the yellow-dye forming DIR coupler combination, upon exposure and development, gives color images having a reduced granularity and a higher color purity, reducing to the minimum the speed decrease of all layers.

SUMMARY OF THE INVENTION

The present invention relates to a light-sensitive silver halide color multilayer photographic material which comprises a support base having coated thereon at least three red-sensitive emulsion layers having different sensitivity, at least three green-sensitive emulsion layers having different sensitivity, and at least two yellow-sensitive emulsion layers having different sensitivity, wherein (a) a core-shell silver halide emulsion having an average silver iodide content lower than 10% mol is present in at least one of the lowest sensitive red-, green- and yellow layers, (b) a yellow dye forming malonodiamide DIR coupler having in the coupling position thereof a 4,7-dihalogen-2-benzotriazolyl group is present in both the medium sensitive red- and green-sensitive layers, and (c) a yellow dye forming DIR coupler having a 1,2,4-triazolyl group attached to the coupling position, such 1,2,4-triazolyl group comprising a hydrolizable alkoxy- or aryloxy-carbonyl group attached to a benzytlthio substituent on the 1,2,4-triazolyl group is present in at least one of the highest sensitive red- and green-sensitive layers.

The specific combination and arrangement of the present invention allows to obtain an improved image quality.

DETAILED DESCRIPTION OF THE INVENTION

The core-shell silver halide emulsion useful in the combination of the present invention has an average silver iodide content lower than 10% mol, preferably lower than 5% mol relative to the total silver halide content. Preferably, the core-shell silver halide emulsion has a silver bromo-iodide composition and comprises an inner core phase and at least one outer shell phase having a different silver halide composition. More preferably, the core-shell silver bromo-iodide emulsion comprises an inner core phase and at least two outer shell phases having a different silver halide composition.

According to a preferred aspect of the present invention, the core-shell silver bromo-iodide emulsion comprises a silver bromo(iodide) core comprising from 0 to 3 mol % of silver iodide relative to the total silver halide content of the core phase, an intermediate silver bromoiodide shell comprising from 1 to 10 mol % of silver iodide relative to the total silver halide content of the intermediate shell phase, and an outer silver bromo(iodide) shell comprising from 0 to 3 mol % of silver iodide relative to the total silver halide content of the outer shell phase.

According to the most preferred aspect of the present invention, the core-shell silver bromo-iodide emulsion comprises a silver bromide core, an intermediate silver bromoiodide shell comprising from 2 to 8 mol % of silver iodide relative to the total silver halide content of the intermediate shell phase, and an outer silver bromide shell.

The core phase preferably comprises from 5 to 15 mol % of silver based on the total silver content, the intermediate shell preferably comprises from 40 to 80 mol % of silver based on the total silver content, and the outer shell preferably comprises from 10 to 40 mol % of silver based on the total silver content.

The core-shell silver bromo-iodide emulsion of the present invention preferably has a low grain size distribution. A common method for quantifying grain size distribution is to extract a sample of individual grains, calculate the corresponding diameter for each grain ($D_{1\rightarrow n}$, wherein n is the number of extracted grains), calculate the average diameter ($Dm=\Sigma_{1\rightarrow n}D/n$), calculate the standard deviation of the grain population diameters (S), divide the standard deviation (S) by the average diameter (Dm) and multiply by 100, thereby obtaining the coefficient of variation (COV) of the grain population as a percentage. The COV of the core-shell silver bromo-iodide emulsion of the present invention is preferably lower than 25%, and more preferably lower than 15%.

The silver iodobromide grains of the emulsion useful in the present invention may be regular grains having a regular crystal structure such as cube, octahedron, and tetradecahedron, or the spherical or irregular crystal structure, or those having crystal defects such as twin plane, or those having a tabular form, or the combination thereof.

The term "cubic grains" according to the present invention is intended to include substantially cubic grains, that is silver iodobromide grains which are regular cubic grains bounded by crystallographic faces (100), or which may have rounded edges and/or vertices or small faces (111), or may even be nearly spherical when prepared in the presence of soluble iodides or strong ripening agents, such as ammonia. Particularly good results are obtained with silver bromoiodide grains having average grain sizes in the range from 0.2 to 3 μm, more preferably from 0.4 to 1.5 μm. Preparation of silver halide emulsions comprising cubic silver iodobromide grains is described, for example, in Research Disclosure, Vol. 184, Item 18431, Vol. 176, Item 17644 and Vol. 308, Item 308119.

Other iodobromide emulsions according to this invention are those which employ one or more light-sensitive tabular grain emulsions. The tabular silver bromoiodide grains contained in the emulsion of this invention have an average diameter:thickness ratio (often referred to in the art as aspect ratio) of at least 2:1, preferably 2:1 to 20:1, more preferably 3:1 to 14:1, and most preferably 3:1 to 8:1. Average diameters of the tabular silver bromoiodide grains suitable for use in this invention range from about 0.3 μm to about 5 μm, preferably 0.5 μm to 3 μm, more preferably 0.8 μm to 1.5 μm. The tabular silver bromoiodide grains suitable for use in this invention have a thickness of less than 0.4 μm, preferably less than 0.3 μm and more preferably less than 0.2 μm.

The tabular grain characteristics described above can be readily ascertained by procedures well known to those skilled in the art. The term "diameter" is defined as the diameter of a circle having an area equal to the projected area of the grain. The term "thickness" means the distance between two substantially parallel main planes constituting the tabular silver halide grains. From the measure of diameter and thickness of each grain the diameter:thickness ratio of each grain can be calculated, and the diameter:thickness ratios of all tabular grains can be averaged to obtain their average diameter:thickness ratio. By this definition the average diameter:thickness ratio is the average of individual tabular grain diameter:thickness ratios. In practice, it is simpler to obtain an average diameter and an average thickness of the tabular grains and to calculate the average diameter:thickness ratio as the ratio of these two averages. Whatever the used method may be, the average diameter:thickness ratios obtained do not greatly differ.

In the silver halide emulsion layer containing tabular silver halide grains, at least 15%, preferably at least 25%, and, more preferably, at least 50% of the silver halide grains are tabular grains having an average diameter:thickness ratio of not less than 2:1. Each of the above proportions, "15%", "25%" and "50%" means the proportion of the total projected area of the tabular grains having a diameter:thickness ratio of at least 2:1 and a thickness lower than 0.4 μm, as compared to the projected area of all of the silver halide grains in the layer.

It is known that photosensitive silver halide emulsions can be formed by precipitating silver halide grains in an aqueous dispersing medium comprising a binder, gelatin preferably being used as a binder.

The silver halide grains may be precipitated by a variety of conventional techniques. The silver halide emulsion can be prepared using a single-jet method, a double-jet method, or a combination of these methods or can be matured using, for instance, an ammonia method, a neutralization method, an acid method, or can be performed an accelerated or constant flow rate precipitation, interrupted precipitation, ultrafiltration during precipitation, etc. References can be found in Trivelli and Smith, The Photographic Journal, Vol. LXXIX, May 1939, pp. 330–338, T. H. James, The Theory of The Photographic Process, 4th Edition, Chapter 3, U.S. Pat. Nos. 2,222,264, 3,650,757, 3,917,485, 3,790,387, 3,716,276, 3,979,213, Research Disclosure, December 1989, Item 308119 "Photographic Silver Halide Emulsions, Preparations, Addenda, Processing and Systems", and Research Disclosure, September 1976, Item 14987.

One common technique is a batch process commonly referred to as the double-jet precipitation process by which a silver salt solution in water and a halide salt solution in water are concurrently added into a reaction vessel containing the dispersing medium.

In the double jet method, in which alkaline halide solution and silver nitrate solution are concurrently added in the gelatin solution, the shape and size of the formed silver halide grains can be controlled by the kind and concentration of the solvent existing in the gelatin solution and by the addition speed. Double-jet precipitation processes are described, for example, in GB 1,027,146, GB 1,302,405, U.S. Pat. No. 3,801,326, U.S. Pat. No. 4,046,376, U.S. Pat. No. 3,790,386, U.S. Pat. No. 3,897,935, U.S. Pat. No. 4,147,551, and U.S. Pat No. 4,171,224.

The single jet method in which a silver nitrate solution is added in a halide and gelatin solution has been long used for manufacturing photographic emulsion. In this method, because the varying concentration of halides in the solution determines which silver halide grains are formed, the formed silver halide grains are a mixture of different kinds of shapes and sizes.

Precipitation of silver halide grains usually occurs in two distinct stages. In a first stage, nucleation, formation of fine silver halide grain occurs. This is followed by a second stage, the growth stage, in which additional silver halide formed as a reaction product precipitates onto the initially formed silver halide grains, resulting in a growth of these silver halide grains. Batch double-jet precipitation processes are typically undertaken under conditions of rapid stirring of reactants in which the volume within the reaction vessel continuously increases during silver halide precipitation and soluble salts are formed in addition to the silver halide grains.

In order to avoid soluble salts in the emulsion layers of a photographic material from crystallizing out after coating and other photographic or mechanical disadvantages (stickiness, brittleness, etc.), the soluble salts formed during precipitation have to be removed.

In preparing silver halide emulsions, a wide variety of hydrophilic dispersing agents for the silver halides can be employed. As hydrophilic dispersing agent, any hydrophilic polymer conventionally used in photography can be advantageously employed including gelatin, a gelatin derivative such as acylated gelatin, graft gelatin, etc., albumin, gum arabic, agar agar, a cellulose derivative, such as hydroxyethylcellulose, carboxymethylcellulose, etc., a synthetic resin, such as polyvinyl alcohol, polyvinylpyrrolidone, polyacrylamide, etc. Other hydrophilic materials useful known in the art are described, for example, in Research Disclosure, Vol. 308, Item 308119, Section IX.

The silver halide grain emulsions can be chemically sensitized using sensitizing agents known in the art. Sulfur containing compounds, gold and noble metal compounds, and polyoxylakylene compounds are particularly suitable. In particular, the silver halide emulsions may be chemically sensitized with a sulfur sensitizer, such as sodium thiosulfate, allylthiocyanate, allylthiourea, thiosulfinic acid and its sodium salt, sulfonic acid and its sodium salt, allylthiocarbamide, thiourea, cystine, etc.; an active or inert selenium sensitizer; a reducing sensitizer such as stannous salt, a polyamine, etc.; a noble metal sensitizer, such as gold sensitizer, more specifically potassium aurithiocyanate, potassium chloroaurate, etc.; or a sensitizer of a water soluble salt such as for instance of ruthenium, rhodium, iridium and the like, more specifically, ammonium chloropalladate, potassium chloroplatinate and sodium chloropalladite, etc.; each being employed either alone or in a suitable combination. Other useful examples of chemical sensitizers are described, for example, in Research Disclosure 17643, Section III 1978 and in Research Disclosure 308119, Section III 1989.

The silver halide emulsion of the present invention can be spectrally sensitized with dyes from a variety of classes, including the polymethyne dye class, which includes the cyanines, merocyanines, complex cyanines and merocyanines, oxonols, hemioxonols, styryls, merostyryls, and streptocyanine.

The cyanine spectral sensitizing dyes include, joined by a methine linkage, two basic heterocyclic nuclei, such as those derived from quinoline, pyrimidine, isoquinoline, indole, benzindole, oxazole, thiazole, selenazole, imidazole, benzoxazole, benzothiazole, benzoselenazole, benzoimidazole, naphthoxazole, naphthothiazole, naphthoselenazole, tellurazole, oxatellurazole.

The merocyanine spectral sensitizing dyes include, joined by a methine linkage, a basic heterocyclic nucleus of the cyanine-dye type and an acidic nucleus, which can be derived from barbituric acid, 2-thiobarbituric acid, rhodanine, hydantoin, 2-thiohydantoin, 2-pirazolin-5-one, 2-isoxazolin-5-one, indan-1,3-dione, cyclohexane-1,3-dione, 1,3-dioxane-4,6-dione, pyrazolin-3,5-dione, pentane-2,4-dione, alkylsulfonylacetonitrile, malononitrile, isoquinolin-4-one, chromane-2,4-dione, and the like.

One or more spectral sensitizing dyes may be used. Dyes with sensitizing maxima at wavelengths throughout the visible and infrared spectrum and with a great variety of spectral sensitivity curve shapes are known. The choice and relative proportion of dyes depends on the region of the spectrum to which sensitivity is desired and on the shape of the spectral sensitivity desired.

Examples of sensitizing dyes can be found in Venkataraman, *The chemistry of Synthetic Dyes*, Academic Press, New York, 1971, Chapter V, James, *The Theory of the Photographic Process,* 4th Ed., Macmillan, 1977, Chapter 8, F. M. Hamer, *Cyanine Dyes and Related Compounds*, John Wiley and Sons, 1964.

Yellow dye forming malonodiamide DIR couplers useful in the present invention are characterized by having a 4,7-dihalogen-2-benzotriazolyl group attached to the active methylene group (active coupling position) of the yellow dye forming coupler through the nitrogen atom in the 2-position of such group, the remaining 5 and 6 positions of such group being substituted or not substituted.

Yellow dye forming malonodiamide DIR couplers useful in the present invention may be represented by formula (I):

(I)

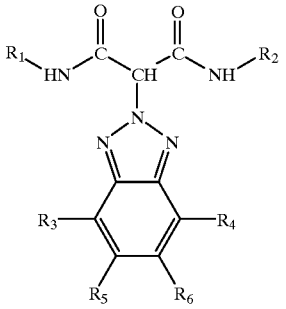

wherein $R_3$ and $R_4$, the same or different, each represent a halogen atom (chlorine, bromine, iodine and fluorine) and $R_5$ and $R_6$, the same or different, each represent a hydrogen atom, a halogen atom (chlorine, bromine, iodine and fluorine), an amino group, an alkyl group having from 1 to 4 carbon atoms (methyl, ethyl, butyl, chloromethyl, trifluoromethyl, 2-hydroxyethyl, etc.), an alkoxy group having from 1 to 4 carbon atoms (methoxy, chloromethoxy, ethoxy, buthoxy, etc.), a hydroxy group, a cyano group, an aryloxy group (phenoxy, p-methoxyphenoxy, etc.), an acyloxy group (acyloxy, benzoyloxy, etc.), an acyl group (acyl, benzoyl, etc.), an alkoxycarbonyl (methoxycarbonyl, butyloxycarbonyl, etc.), an aryloxycarbonyl (benzoxycarbonyl, etc.), an acylamino group (acetamido, benzamido, etc.), an alkylsulfonyl group (methylsulfonyl, chloromethylsulfonyl, etc.), an arylsulfonyl group (phenylsulfonyl, naphthylsulfonyl, etc.), an alkoxysulfonyl group (ethoxysufonyl, buthoxysulfonyl, etc.), an aryloxysulfonyl (phenoxysulfonyl, 2-methoxyfenoxysulfonyl, etc.) or a ureido group (phenylureido, butanureido, etc.); $R^1$ and $R_2$ each represent an alkyl group (with 1 to 20 carbon atoms) or an aryl group (with from 3 to 20 carbon atoms, especially a phenyl group).

In the above reported formula (I), the alkyl group represented with $R_1$ and $R_2$ preferably has from 1 to 18 carbon atoms and may be substituted or non substituted. Preferred examples of the alkyl group substituents comprise an alkoxy, aryloxy, cyano, amino, acylamino group, a halogen atom, a hydroxy, carboxy, sulfo, heterocyclic group, etc. Practical examples of useful alkyl groups are an iso-propyl, an iso-butyl, a tert.-butyl, an iso-amyl, a tert.-amyl, a 1,1-dimethylbutyl, a 1,1-dimethylhexyl, a 1,1-diethylhexyl, a 1,1-dimethyl-1-methoxyfenoxymethyl, a 1,1-dimethyl1-ethylthiomethyl, a dodecyl, a hexadecyl, an octadecyl, a cyclohexyl, a 2-methoxyisopropyl, a 2-fenoxyisopropyl, an a-aminoisopropyl, an a-succinimidoisopropyl group, etc.

Specific examples of yellow dye forming malonodiamide DIR couplers to be used in the present invention are reported hereinbelow as illustrative examples.

I-1

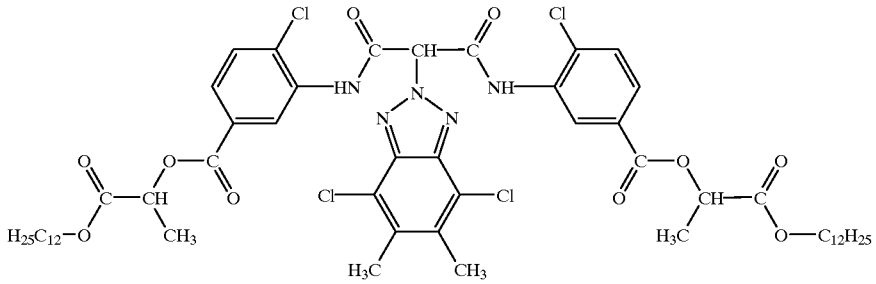

I-2

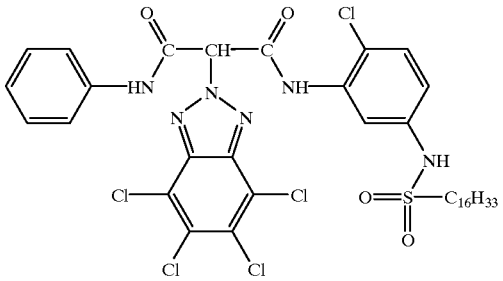

I-3

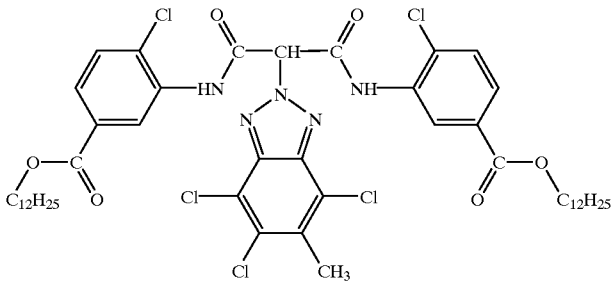

-continued
I-4
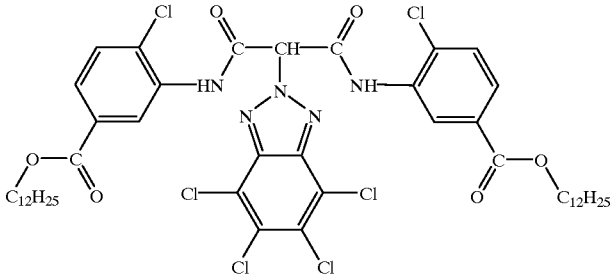
I-5
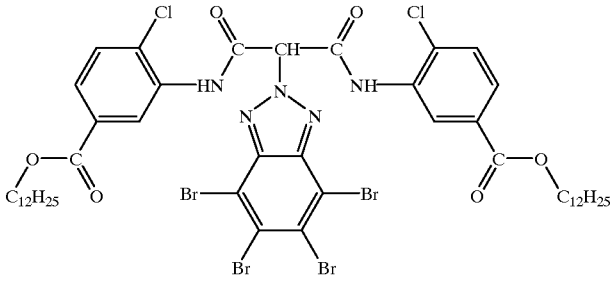
I-6
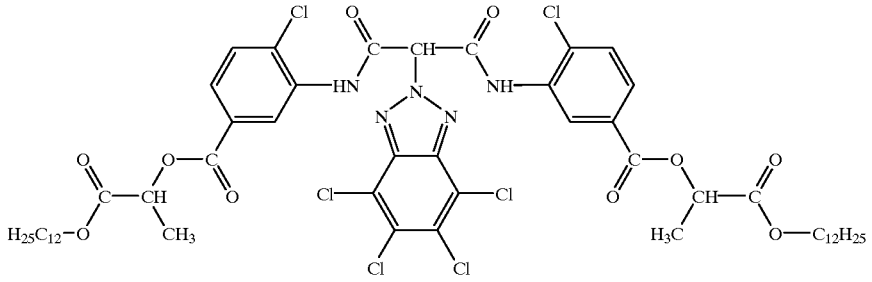
I-7
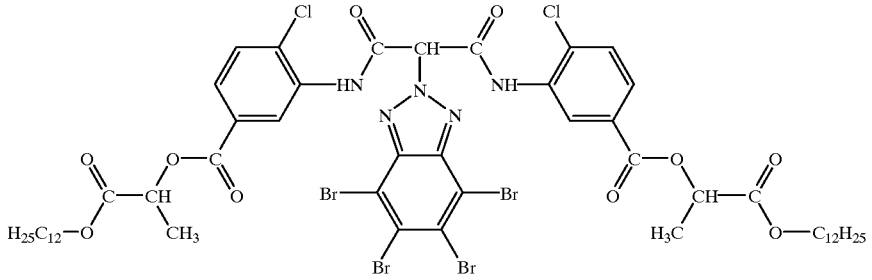
I-8
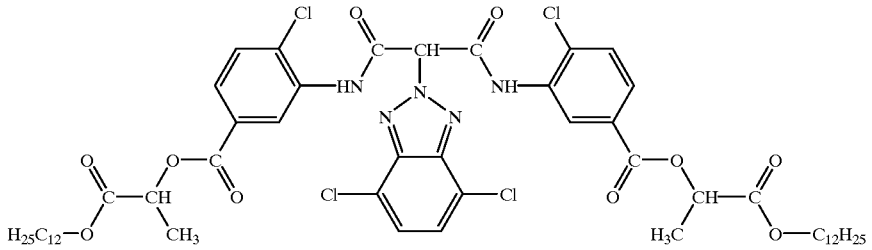

-continued
I-9
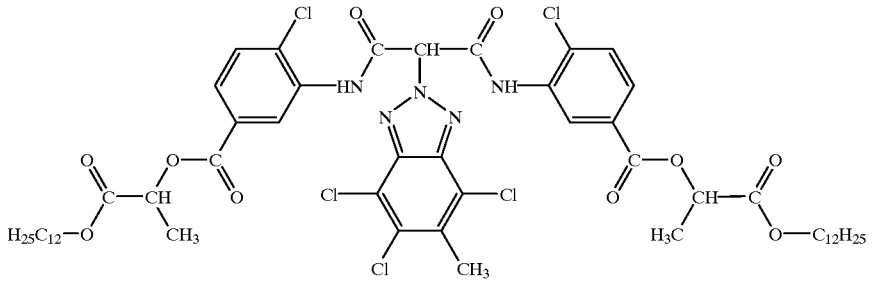
I-10
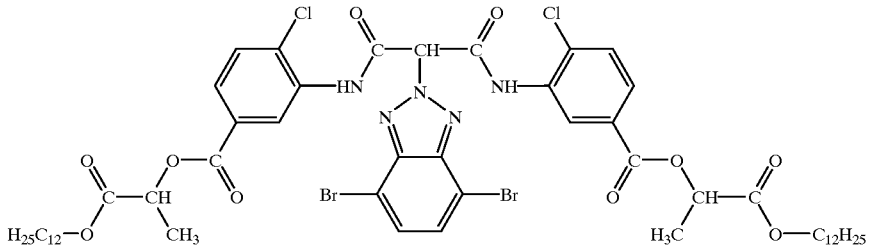
I-11
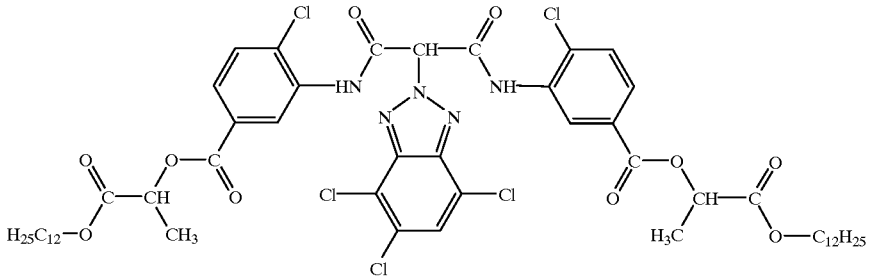
I-12
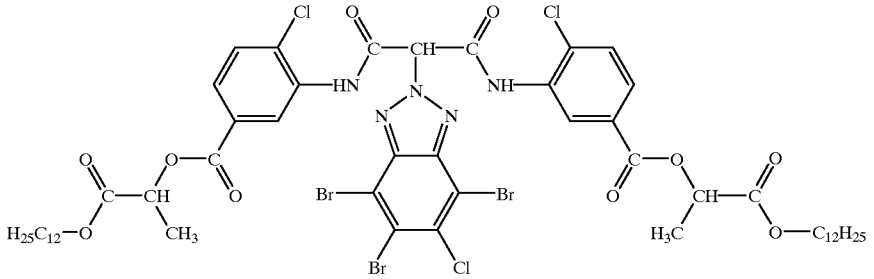
I-13
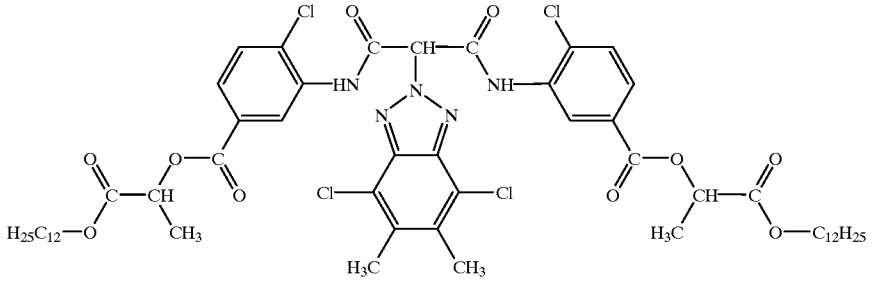

-continued

I-14

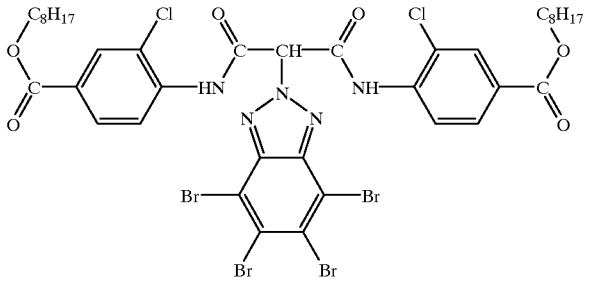

I-15

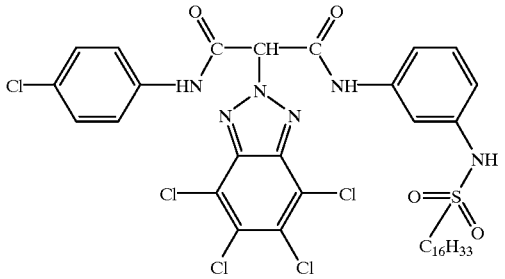

I-16

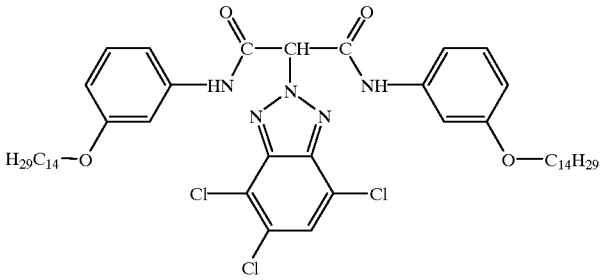

I-17

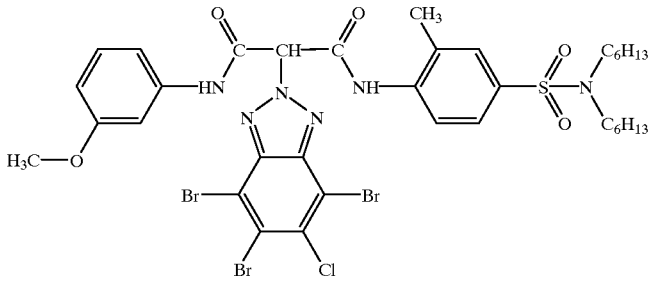

The yellow dye forming malonodiamide DIR couplers to be used in the present invention can be synthesized by following methods which are known from the DIR coupler synthesization, as described in U.S. Pat. No. 5,006,452.

The quantity of the yellow dye forming malonodiamide DIR couplers to be incorporated ranges from about 0.001 to about 0.040 grams per square meter, preferably from 0.005 to 0.030 grams per square meter of the color photographic element.

Yellow dye forming DIR couplers having a 1,2,4-triazolyl group attached to the coupling position thereof, to be used in the present invention, may be represented by the following formula (II):

(II)

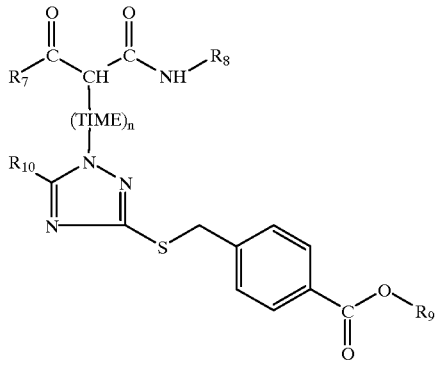

wherein $R_7$ represents an alkyl, aryl or $NHR_{11}$ group, where $R_{11}$ is an alkyl or aryl group, $R_8$ represents an alkyl or aryl group, TIME represents a "timing" group, n is 0 or 1, $R_9$ represents an alkyl or phenyl, and $R_{10}$ represents a hydrogen atom or an alkyl group.

In formula (II) above, the alkyl group represented with $R_7$, $R_8$ and $R_{11}$ preferably has from 1 to 18 carbon atoms and may be substituted or unsubstituted. Preferred examples of alkyl group substituents comprise an alkoxy, aryloxy, cyano, amino, acylamino group, a halogen atom, a hydroxy, carboxy, sulfo, heterocyclic group, etc. Practical examples of useful alkyl groups are an iso-propyl, iso-butyl, tert.-butyl, iso-amyl, tert.-amyl, 1,1-dimethylbutyl, 1,1-dimethylhexyl, 1,1-diethylhexyl, 1,1-dimethyl-1-methoxyphenoxymethyl, 1,1-dimethyl-1-ethylthio-methyl, dodecyl, hexadecyl, octadecyl, cyclohexyl, 2-methoxyisopropyl, 2-fenoxyisopropyl, a-aminoisopropyl, a-sucinimidoisopropyl group.

The aryl group represented with $R_7$, $R_8$ and $R_{11}$ preferably has a total of from 6 to 35 carbon atoms and comprises in particular a substituted phenyl group and an unsubstituted phenyl group. Preferred examples of substituents in the aryl group comprise a halogen atom, a nitro, cyano, thiocyano, hydroxy, alkoxy (preferably having from 1 to 15 carbon atoms, such as methoxy, isopropoxy, octyloxy, etc.), aryloxy (phenoxy, nitrophenoxy, etc.), alkyl (preferably having form 1 to 15 carbon atoms, such as methyl, ethyl, dodecyl, etc.), alkenyl (preferably having from 1 to 15 carbon atoms, such as allyl), aryl (preferably having from 6 to 10 carbon atoms, such as phenyl, tolyl, etc.), amino (for example an unsubstituted amino group or an alkylamino having from 1 to 15 carbon atoms, such as diethylamino, octylamino, etc.), carboxy, acyl (preferably having from 2 to 16 carbon atoms, such as acetyl, decanoyl, etc.), alkoxycarbonyl (preferably having a 1 to 20 carbon atom alkyl unit, such as methoxycarbonyl, butoxycarbonyl, octyloxycarbonyl, dodecyloxycarbonyl, 2-methoxyethoxycarbonyl, etc.), aryloxycarbonyl (preferably having a 6 to 20 carbon atom alkyl unit, such as phenoxycarbonyl, tolyloxycarbonyl, etc.), carbamoyl (such as ethylcarbamoyl, octylcarbamoyl, etc.), acylamino (preferably having from 2 to 21 carbon atoms, such as acetamido, octanamido, 2,4-ditert.-pentylfenoxyacetamido, etc.), sulfo, alkylsulfonyl (preferably having from 1 to 15 carbon atoms, such as methylsulfonyl, octylsulfonyl, etc.), arylsulfonyl (preferably having from 6 to 20 carbon atoms, such as phenylsulfonyl, octylphenylsulfonyl, etc.), alkoxysulfonyl (preferably having from 1 to 15 carbon atoms, such as methoxysulfonyl, octyloxysulfonyl, etc.), aryloxysulfonyl (preferably having from 6 to 20 carbon atoms, such as phenoxysulfonyl, etc.), sulfamoyl (preferably having from 1 to 15 carbon atoms, such as diethylsulfamoyl, octylsulfamoyl, methyloctadecylsulfamoyl, etc.), sulfonamino group (preferably having from 1 to 15 carbon atoms, such as methylsulfonamino, octylsulfonamino, etc.), and the like.

TIME is a "timing" group which links the coupler residue with 1,2,4-triazolyl group and is released together with 1,2,4-triazolyl group during the coupling reaction with the oxidation product of a color developing agent and in its turn releases the 1,2,4-triazolyl group later on during development. Examples of timing groups represented with TIME in formula (II) comprise for examples the following groups:

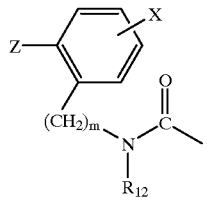

wherein Z is an oxygen or sulfur atom and is attached to the couplers, m is 0 or 1, $R_{12}$ is hydrogen or an alkyl with from 1 to 4 carbon atoms or an aryl group from 6 to 10 carbon atoms, X is a hydrogen or halogen atom, or a cyano, nitro, alkyl with 1 to 20 carbon atoms, alkoxy, alkoxycarbonyl, acylamino, aminocarbonyl group, etc., as described in U.S. Pat. No. 4,248,962,

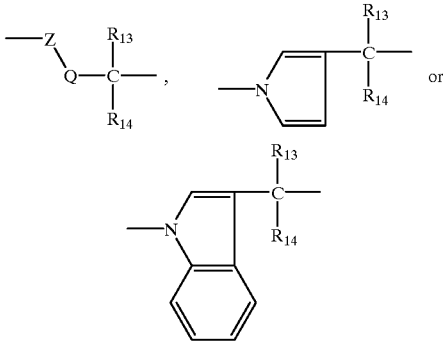

where the left portion is attached to the coupler and Z is oxygen or sulfur or

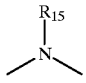

$R_{13}$, $R_{14}$ and $R_{15}$ each are hydrogen, alkyl or aryl groups and Q is a 1,2- or 1,4-phenylene or naphthylene group, as described in U.S. Pat. No. 4,409,323.

The alkyl group represented with $R_9$ and $R_{10}$ preferably is a lower 1 to 4 carbon atom alkyl group, such as methyl, ethyl, propyl, isopropyl,n-butyl and tert.-butyl.

Specific yellow dye forming DIR couplers of formula (II) to be used in the present invention are illustrated hereinbelow, even if the invention is not limited thereto.

II-1
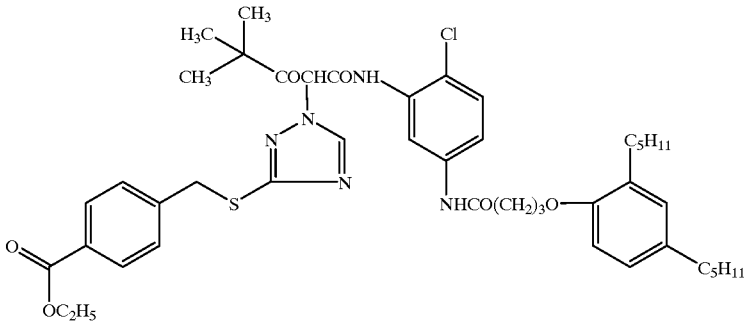
II-2
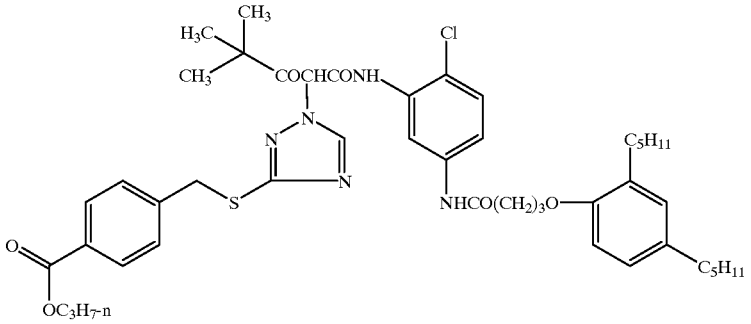
II-3
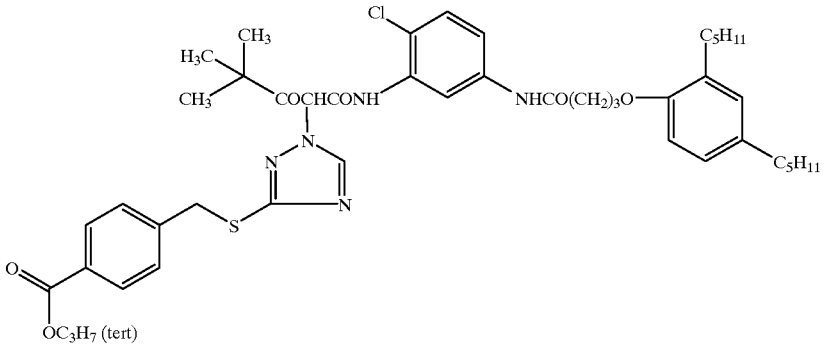
II-4
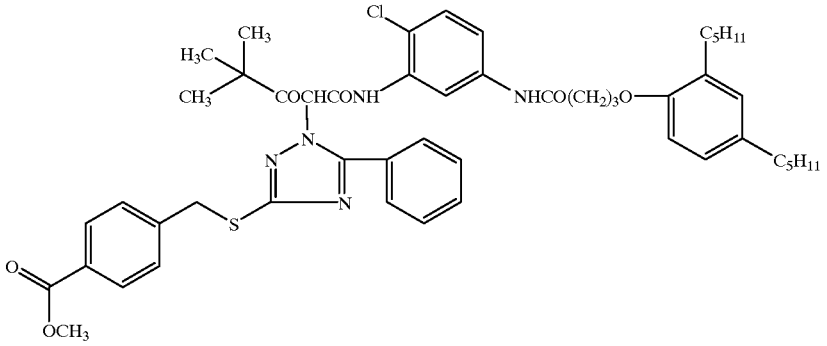

-continued
II-5
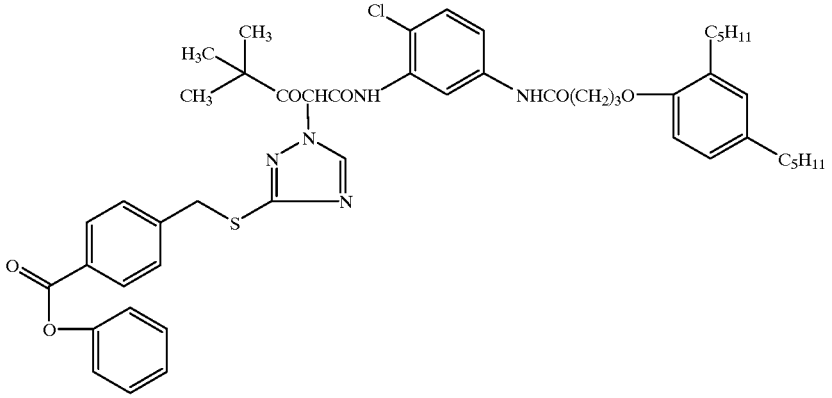
II-6
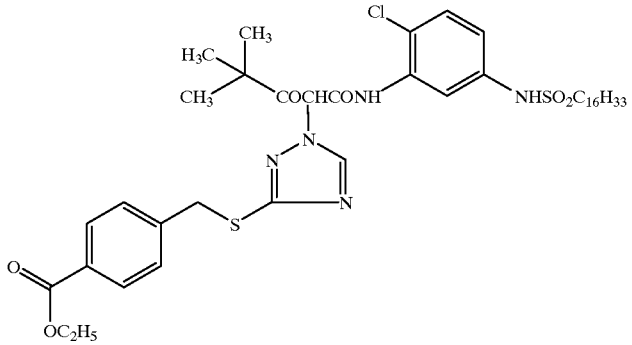
II-7
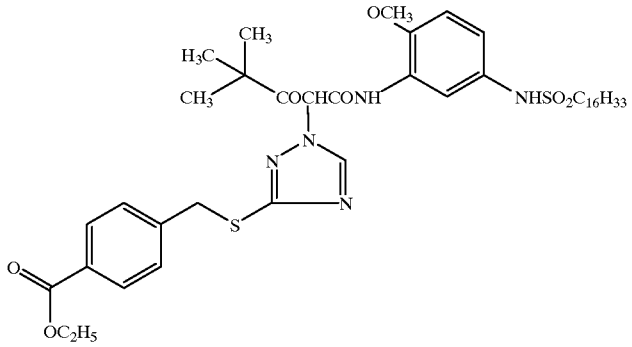
II-8
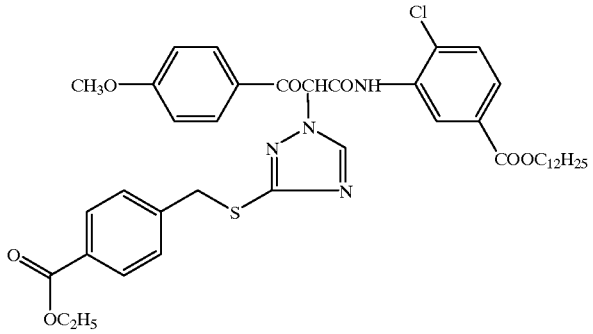

-continued
II-9
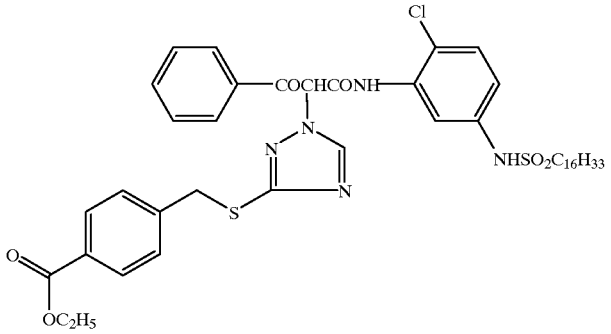
II-10
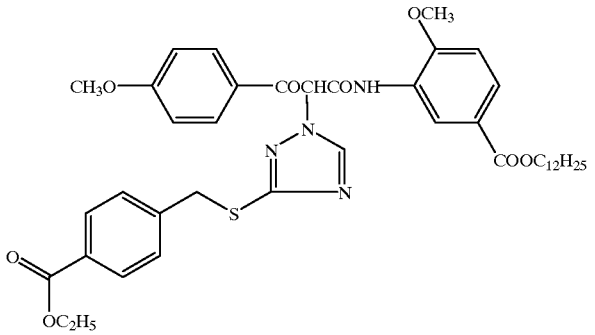
II-11
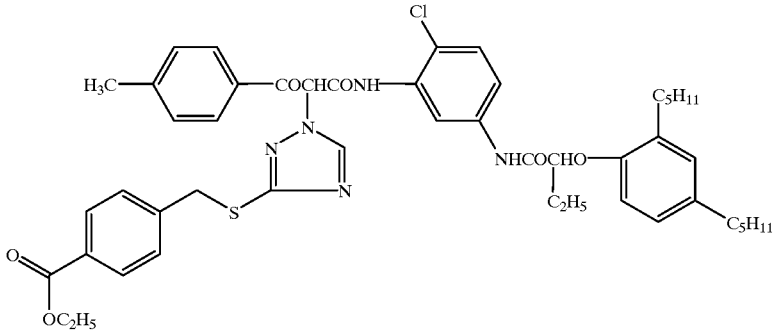
II-12
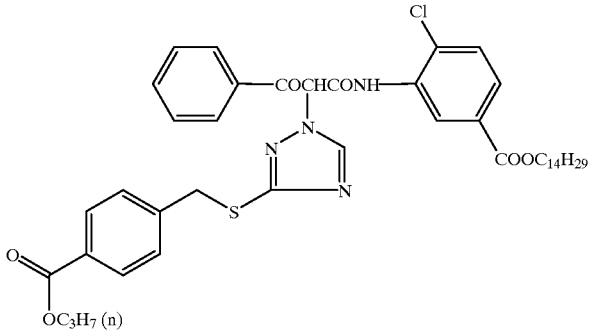

-continued
II-13
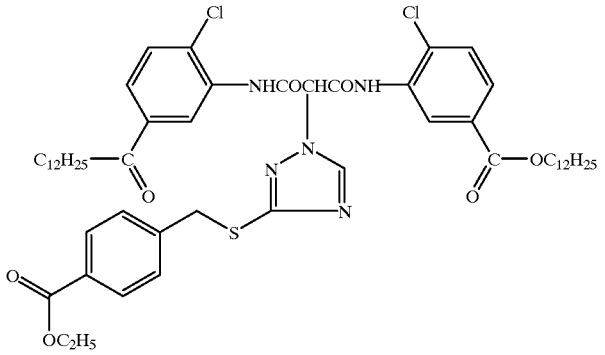
II-14
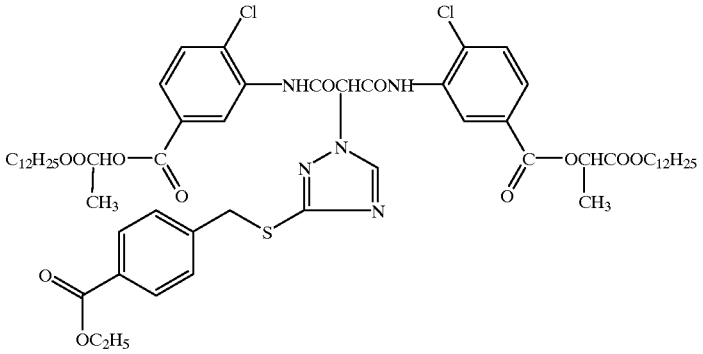
II-15
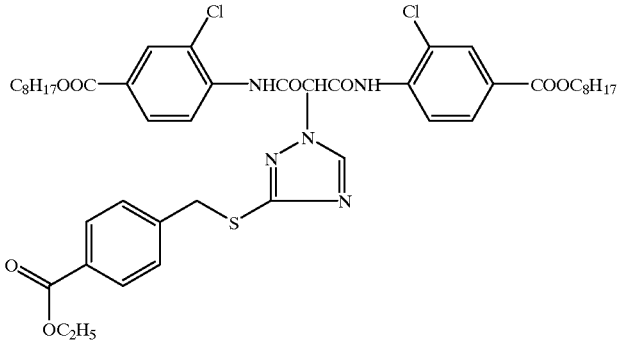
II-16
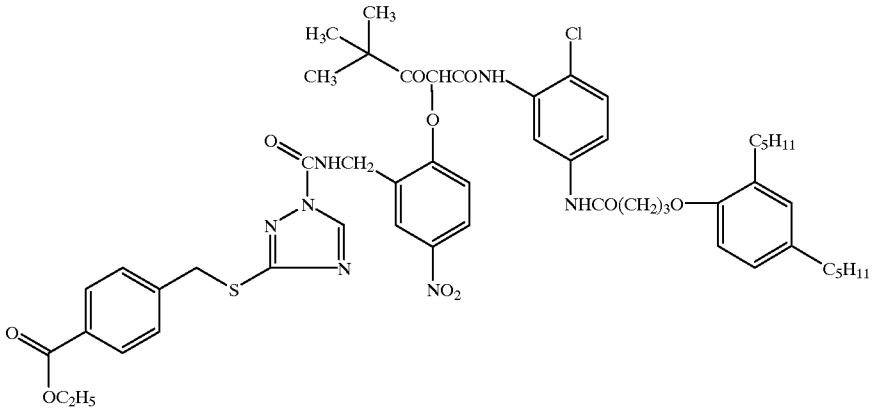

The yellow dye forming DIR couplers having a 1,2,4-triazolyl group attached to the coupling position thereof to be used in the present invention can be prepared according to the conventional procedures for the preparation of DIR couplers, see for instance EP patent application 747,763.

The quantity of yellow dye forming DIR couplers, having a 1,2,4-triazolyl group attached to the coupling position, to be incorporated ranges from about 0.005 to about 0.100 grams per square meter, preferably from about 0.010 to about 0.040 grams per square meter of the color photographic element.

The above described silver halide emulsion and yellow dye forming DIR couplers are incorporated in the light-sensitive silver halide photographic element according to the present invention, in particular color negative photographic elements, color reversal photographic elements, and the like.

The silver halide color photographic element according to the present invention comprise, coated on a support, at least three red-sensitive emulsion layers having different sensitivity associated with cyan dye-forming color couplers, at least three green-sensitive emulsion layers having different sensitivity associated with magenta dye-forming color couplers, and at least two yellow-sensitive emulsion layers having different sensitivity associated with yellow dye-forming color couplers. These elements additionally comprise other non-light sensitive layers, such as intermediate layers, filter layers, antihalation layers and protective layers, thus forming a multilayer structure. These color photographic elements, after imagewise exposure to actinic radiation, are processed in a chromogenic developer to yield a visible color image. The layer units can be coated in any conventional order, but in a preferred layer arrangement the red-sensitive layers are coated nearest the support and are overcoated by the green-sensitive layers, a yellow filter layer and the blue-sensitive layers.

Suitable color couplers are preferably selected from the couplers having diffusion preventing groups, such as groups having a hydrophobic organic residue of about 8 to 32 carbon atoms, introduced into the coupler molecule in a non-splitting-off position. Such a residue is called a "ballast group". The ballast group is bonded to the coupler nucleus directly or through an imino, ether, carbonamido, sulfonamido, ureido, ester, imido, carbamoyl, sulfamoyl bond, etc. Examples of suitable ballasting groups are described in U.S. Pat. No. 3,892,572.

Said non-diffusible couplers are introduced into the light-sensitive silver halide emulsion layers or into non-light-sensitive layers adjacent thereto. On exposure and color development, said couplers give a color which is complementary to the light color to which the silver halide emulsion layers are sensitive. Consequently, at least one non-diffusible cyan-image forming color coupler, generally a phenol or an x-naphthol compound, is associated with red-sensitive silver halide emulsion layers, at least one non-diffusible magenta image-forming color coupler, generally a 5-pyrazolone or a pyrazolotriazole compound, is associated with green-sensitive silver halide emulsion layers and at least one non-diffusible yellow image forming color coupler, generally a acylacetanilide compound, is associated with blue-sensitive silver halide emulsion layers.

Said color couplers may be 4-equivalent and/or 2-equivalent couplers, the latter requiring a smaller amount of silver halide for color production. As is well known, 2-equivalent couplers derive from 4-equivalent couplers since, in the coupling position, they contain a substituent which is released during coupling reaction. 2-Equivalent couplers which may be used in silver halide color photographic elements include both those substantially colorless and those which are colored ("masked couplers"). The 2-equivalent couplers also include leuco couplers which do not form any dye on reaction with the color developer oxidation products.

The most useful cyan-forming couplers are conventional phenol compounds and a-naphthol compounds. Examples of cyan couplers can be selected from those described in U.S. Pat. Nos. 2,369,929; 2,474,293; 3,591,383; 2,895,826; 3,458,315; 3,311,476; 3,419,390; 3,476,563 and 3,253,924; and in British patent 1,201,110.

The most useful magenta-forming couplers are conventional pyrazolone type compounds, indazolone type compounds, cyanoacetyl compounds, pyrazoletriazole type compounds, etc, and particularly preferred couplers are pyrazolone type compounds. Magenta-forming couplers are described for example in U.S. Pat. No. 2,600,788, 2,983,608, 3,062,653, 3,127,269, 3,311,476, 3,419,391, 3,519,429, 3,558,319, 3,582,322, 3,615,506, 3,834,908 and 3,891,445, in DE patent 1,810,464, in DE patent applications 2,408,665, 2,417,945, 2,418,959 and 2,424,467 and in JP patent applications 20,826/76, 58,922/77, 129,538/74, 74,027/74, 159,336/75, 42,121/77, 74,028/74, 60,233/75, 26,541/76 and 55,122/78.

The most useful yellow-forming couplers are conventional open-chain ketomethylene type couplers. Particular examples of such couplers are benzoylacetanilide type and pivaloyl acetanilide type compounds. Yellow-forming couplers that can be used are specifically described in U.S. Pat. Nos. 2,875,057, 3,235,924, 3,265,506, 3,278,658, 3,369,859, 3,408,194, 3,415,652 3,528,322, 3,551,151, 3,682,322, 3,725,072 and 3,891,445, in DE patents 2,219,917, 2,261,361 and 2,414,006, in GB patent 1,425,020, in JP patent 10,783/76 and in JP patent applications 26,133/72, 73,147/73, 102,636/76, 6,341/75, 123,342/75, 130,442/75, 1,827/76, 87,650/75, 82,424/77 and 115,219/77.

Colored couplers can be used which include those described for example in U.S. Pat. Nos. 3,476,560, 2,521,908 and 3,034,892, in JP patent publications 2,016/69, 22,335/63, 11,304/67 and 32,461/69, in JP patent applications 26,034/76 and 42,121/77 and in DE patent application 2,418,959. The light-sensitive silver halide color photographic element may contain high molecular weight color couplers as described for example in U.S. Pat. No. 4,080,211, in EP Pat. Appl. No. 27,284 and in DE Pat. Appl. Nos. 1,297,417, 2,407,569, 3,148,125, 3,217,200, 3,320,079, 3,324,932, 3,331,743, and 3,340,376.

Colored cyan couplers can be selected from those described in U.S. Pat. Nos. 3,934,802; 3,386,301 and 2,434,272, colored magenta couplers can be selected from the colored magenta couplers described in U.S. Pat. Nos. 2,434,272; 3,476,564 and 3,476,560 and in British patent 1,464,361. Colorless couplers can be selected from those described in British patents 861,138; 914,145 and 1,109,963 and in U.S. Pat. No. 3,580,722.

Also, couplers providing diffusible colored dyes can be used together with the above mentioned couplers for improving graininess and specific examples of these couplers are magenta couplers described in U.S. Pat. No. 4,366,237 and GB Pat. No. 2,125,570 and yellow, magenta and cyan couplers described in EP Pat. No. 96,873, and in DE Pat. Appl. No. 3,324,533.

Also, among the 2-equivalent couplers are those couplers which carry in the coupling position a group which is released in the color development reaction to give a certain photographic activity, e.g. as development inhibitor or accelerator or bleaching accelerator, either directly or after removal of one or further groups from the group originally released. Examples of such 2-equivalent couplers include the yellow DIR couplers described above as well as other DIR, DAR, FAR and BAR couplers. Typical examples of said couplers are described in DE Pat. Appl. Nos. 2,703,145, 2,855,697, 3,105,026, 3,319,428, 1,800,420, 2,015,867, 2,414,006, 2,842,063, 3,427,235, 3,209,110, and 1,547,640, in GB Pat. Nos. 953,454 and 1,591,641, and in EP Pat. Appl. Nos. 89,843, 117,511, 118,087, 193,389, and 301,477.

Examples of non-color forming DIR coupling compounds which can be used in silver halide color elements include those described in U.S. Pat. Nos. 3,938,996; 3,632,345; 3,639,417; 3,297,445 and 3,928,041; in German patent applications S.N. 2,405,442; 2,523,705; 2,460,202; 2,529,350 and 2,448,063; in Japanese patent applications S.N. 143,538/75 and 147,716/75 and in British patents 1,423,588 and 1,542,705.

In order to introduce the couplers into the silver halide emulsion layer, some conventional methods known to the skilled in the art can be employed. According to U.S. Pat. Nos. 2,322,027, 2,801,170, 2,801,171 and 2,991,177, the couplers can be incorporated into the silver halide emulsion layer by the dispersion technique, which consists of dissolving the coupler in a water-immiscible high-boiling organic solvent and then dispersing such a solution in a hydrophilic colloidal binder under the form of very small droplets. The preferred colloidal binder is gelatin, even if some other kinds of binders can be used.

Another type of introduction of the couplers into the silver halide emulsion layer consists of the so-called "loaded-latex technique". A detailed description of such technique can be found in BE patents 853,512 and 869,816, in U.S. Pat. Nos. 4,214,047 and 4,199,363 and in EP patent 14,921. It consists of mixing a solution of the couplers in a water-miscible organic solvent with a polymeric latex consisting of water as a continuous phase and of polymeric particles having a mean diameter ranging from 0.02 to 0.2 micrometers as a dispersed phase.

Another useful method is further the Fisher process. According to such a process, couplers having a water-soluble group, such as a carboxyl group, a hydroxy group, a sulfonic group or a sulfonamido group, can be added to the photographic layer for example by dissolving them in an alkaline water solution.

The photographic elements, including a silver halide emulsion according to this invention, may be processed to form a visible image upon association of the silver halides with an alkaline aqueous medium in the presence of a developing agent contained in the medium or in the material, as known in the art. The aromatic primary amine color developing agent used in the photographic color developing composition can be any of known compounds of the class of p-phenylendiamine derivatives, widely employed in various color photographic process. Particularly useful color developing agents are the p-phenylendiamine derivatives, especially the N,N-dialkyl-p-phenylene diamine derivatives wherein the alkyl groups or the aromatic nucleus can be substituted or not substituted.

Examples of p-phenilene diamine developers include the salts of: N,N-diethyl-p-phenylendiamine, 2-amino-5-diethylamino-toluene, 4-amino-N-ethyl-N-(α-methanesulphonamidoethyl)-m-toluidine, 4-amino-3-methyl-N-ethyl-N-((α-hydroxyethyl)-aniline, 4-amino-3-(α-methylsulfonamidoethyl)-N,N-diethylaniline, 4-amino-N,N-diethyl-3-(N'-methyl-α-methylsulfonamido)-aniline, N-ethyl-N-methoxy-ethyl-3-methyl-p-phenylenediamine and the like, as described, for instance, in U.S. Pat. Nos. 2,552,241; 2,556,271; 3,656,950 and 3,658,525.

Examples of commonly used developing agents of the p-phenylene diamine salt type are: 2-amino-5-diethylaminotoluene hydrochloride (generally known as CD2 and used in the developing solutions for color positive photographic material), 4-amino-N-ethyl-N-(α-methanesulfonamidoethyl)-m-toluidine sesquisulfate monohydrate (generally known as CD3 and used in the developing solution for photographic papers and color reversal materials) and 4-amino-3-methyl-N-ethyl-N-(β-hydroxyethyl)-aniline sulfate (generally known as CD4 and used in the developing solutions for color negative photographic materials).

Said color developing agents are generally used in a quantity from about 0.001 to about 0.1 moles per liter, preferably from about 0.0045 to about 0.04 moles per liter of photographic color developing compositions.

In the case of color photographic materials, the processing comprises at least a color developing bath and, optionally, a prehardening bath, a neutralizing bath, a first (black and white) developing bath, etc. These baths are well known in the art and are described for instance in Research Disclosure 17643, 1978.

After color development, the image-wise developed metallic silver and the remaining silver salts generally must be removed from the photographic element. This is performed in separate bleaching and fixing baths or in a single bath, called blix, which bleaches and fixes the image in a single step. The bleaching bath is a water solution having a pH equal to 5.60 and containing an oxidizing agent, normally a complex salt on an alkali metal or of ammonium and of trivalent iron with an organic acid, e.g. EDTA.Fe.$NH_4$, wherein EDTA is the ethylenediaminotetracetic acid. While processing, this bath is continuously aired to oxidize the divalent iron which forms while bleaching the silver image and regenerated, as known in the art, to maintain the bleach effectiveness. The bad working of these operations may cause the drawback of the loss of cyan density of the dyes.

Further to the above mentioned oxidizing agents, the blix bath contains known fixing agents, such as for example ammonium or alkali metal thiosulfates. Both bleaching and fixing baths can contain other additives, e.g. polyalkyleneoxide derivatives, as described in GB patent 933,008 in order to increase the effectiveness of the bath, or thioethers known as bleach accelerators.

The present invention will be illustrated with reference to the following examples, but it should be understood that these examples do not limit the present invention.

EXAMPLE 1

A multilayer color photographic element (Sample 101, comparison example) was prepared by coating layers of the hereinafter reported composition onto a transparent cellulose acetate film support provided with a gelatin underlayer. In the hereinafter reported compositions, the coating quantity of silver halides (expressed as silver-equivalent), gelatin and other additions are reported in grains per square meter ($g/m^2$). All silver halide emulsions were stabilized with 4-hydroxy-6-methyl-1,3,3a,7-tetrazaindene and spectrally sensitized with suitable sensitizing dyes for the red, green and blue light of the spectrum.

| Layer 1 (Antihalo Layer) | |
|---|---|
| Black colloidal silver | 0.2 |
| Gelatin | 1.31 |
| Dye 1 | 0.029 |
| Dye 2 | 0.028 |
| Magenta Masked Coupler MM-1 | 0.033 |
| Magenta Masked Coupler MM-2 | 0.017 |
| Layer 2 (Interlayer) | |
| Gelatin | 1.160 |
| UV-1 | 0.054 |
| UV-2 | 0.054 |
| Compound 1 | 0.020 |
| Layer 3 (Red-Sensitive Low Sensitivity Layer) | |
| Silver iodobromide emulsion A (AgI 2.5% moles, average diameter 0.22 μm) | 0.670 |
| Gelatin | 1.310 |
| Cyan Coupler C-1 | 0.323 |
| Cyan Masked Coupler CM-1 | 0.008 |
| Dye 1 | 0.015 |
| Dye 2 | 0.005 |
| Layer 4 (Red-Sensitive Medium Sensitivity Layer) | |
| Silver Iodobromide Emulsion B (AgI 6% moles, average diameter 0.60 μm) | 0.720 |
| Gelatin | 1.130 |
| Cyan Coupler C-1 | 0.277 |
| DIR Coupler D-1 | 0.016 |
| Cyan Masked Coupler CM-1 | 0.039 |
| Layer 5 (Red-Sensitive High Sensitivity Layer) | |
| Silver Iodobromide Emulsion C (AgI 12% moles, average diameter 1.10 μm) | 0.970 |
| Gelatin | 1.160 |
| Cyan coupler C-1 | 0.141 |
| Cyan Coupler C-2 | 0.022 |
| DIR Coupler D-1 | 0.012 |
| Cyan Masked Coupler CM-1 | 0.020 |
| Layer 6 (Interlayer) | |
| Gelatin | 1.250 |
| Compound-1 | 0.056 |
| Hardener H-1 | 0.073 |
| Layer 7 (Green-Sensitive Low Sensitivity Layer) | |
| Silver Iodobromide Emulsion A (AgI 2.5% moles, average diameter 0.22 μm) | 0.390 |
| Gelatin | 1.180 |
| Magenta Coupler M-1 | 0.273 |
| Masked Magenta Coupler MM-1 | 0.026 |
| Masked Magenta Coupler MM-2 | 0.013 |
| Compound-1 | 0.080 |
| Layer 8 (Green-Sensitive Medium Sensitivity Layer) | |
| Silver Iodobromide Emulsion B (AgI 6.0% moles, average diameter 0.60 μm | 0.612 |
| Gelatin | 0.940 |
| Magenta Coupler M-1 | 0.120 |
| DIR Coupler D-2 | 0.010 |
| Masked Magenta Coupler MM-1 | 0.037 |
| Masked Magenta Coupler MM-2 | 0.018 |
| Compound-1 | 0.010 |
| Layer 9 (Green-Sensitive High Sensitivity Layer) | |
| Silver Iodobromide Emulsion C (AgI 12.0% moles, average diameter 1.10 μm) | 1.290 |
| Gelatin | 1.620 |
| Magenta Coupler M-1 | 0.230 |
| DIR Coupler D-2 | 0.016 |
| Masked Magenta Coupler MM-1 | 0.044 |
| Masked Magenta Coupler MM-2 | 0.021 |
| Layer 10 (Interlayer) | |
| gelatin | 1.050 |

-continued

| Layer 11 (Yellow Filter Layer) | |
|---|---|
| Gelatin | 1.020 |
| Yellow Colloidal Silver | 0.055 |
| Hardener H-1 | 0.064 |
| Layer 12 (Blue-Sensitive Low Sensitivity Emulsion Layer) | |
| Silver Iodobromide Emulsion A (AgI 2.5% moles, average diameter 0.22 μm) | 0.210 |
| Silver Iodobromide Emulsion B (AgI 6.0% moles, average diameter 0.60 μm) | 0.230 |
| Gelatin | 1.250 |
| Yellow Coupler Y-1 | 0.751 |
| Yellow DIR Coupler Y-1 | 0.040 |
| Layer 13 (Blue-Sensitive High Sensitivity Emulsion Layer) | |
| Silver Iodobromide Emulsion C (AgI 12% moles, average diameter 1.10 μm) | 0.550 |
| Gelatin | 1.360 |
| Yellow Coupler Y-1 | 0.325 |
| Cyan coupler C-2 | 0.008 |
| Yellow DIR Coupler Y-1 | 0.033 |
| Yellow DIR Coupler Y-2 | 0.016 |
| Layer 14 (1st Protective Layer) | |
| Unsensitized Silver bromide Lippmann Emulsion | 0.200 |
| Gelatin | 1.120 |
| UV-1 | 0.095 |
| UV-2 | 0.095 |
| Compound-2 | 0.131 |
| Layer 15 (2nd Protective Layer) | |
| Gelatin | 0.085 |
| Polymethylmethacrylate Matting Particles | 0.013 |
| (Ethylmethacrylate-Methacylic Acid) Copolymer Matting Agent | 0.172 |
| Hardener H-2 | 0.374 |

Another multilayer color photographic material was then prepared (Comparison Sample 102) with the same layer formulation of Sample 101 except that Emulsion A of the $3^{rd}$, $7^{th}$ and $12^{th}$ layers was replaced by Emulsion 1 at a 10% lower coverage. Another multilayer color photographic material (Comparison Sample 103) was prepared like Sample 101, with the exception of replacing DIR Coupler D-1 with 0.010 g of Yellow DIR Coupler Y-2 (corresponding to I-1 listed above) in the $4^{th}$ layer, replacing DIR Coupler D-1 with 0.014 g of Yellow DIR Coupler Y-1 (corresponding to II-1 listed above) in the $5^{th}$ layer, and replacing DIR Coupler D-2 with 0.010 g of Yellow DIR Coupler Y-2 (corresponding to I-1 listed above) in the $8^{th}$ layer. Another multilayer color photographic material (Invention Sample 104) was prepared like Sample 103, with the exception that Emulsion A of the $3^{rd}$, $7^{th}$ and $12^{th}$ layers was replaced by Emulsion 1 at a 10% lower coverage.

Emulsion A is a cube-octahedral silver bromoiodide emulsion having a uniform distribution of iodide and an average iodide content of 2.5%. Emulsion 1 is a cube-octahedral core-shell bromo-iodide emulsion having a core of pure silver bromide (accounting for 10%mol relative to the total silver halide content), a first shell of silver bromo-iodide containing 4.7% mole of iodide (accounting for 65% mol relative to the total silver halide content), and an outer shell of pure silver bromide (accounting for 25%mol relative to the total silver halide content). The total average iodide content is 3% mole. The average diameter is 0.40 μm with a coefficient of dispersion of about 20%.

Samples of each film were exposed to a white light source having a color temperature of 5,500° K. All exposed samples were developed with a standard C41 processing, as described in British Journal of Photography, Jul. 12, 1974, pages 597–598. The speeds of the red-sensitive, green-sensitive and blue-sensitive layers, obtained at a density of 0.2 above minimum density as well as Dmin, Dmax and contrast are reported in the following tables I to III.

TABLE I

| CYAN | Dmin | Dmax | Speed | Contrast |
|---|---|---|---|---|
| 101 (Comp) | 0.28 | 2.21 | 1.97 | 0.61 |
| 102 (Comp) | 0.28 | 2.37 | 1.98 | 0.61 |
| 103 (Comp) | 0.29 | 2.56 | 2.05 | 0.70 |
| 104 (Inv) | 0.27 | 2.73 | 2.02 | 0.70 |

TABLE II

| MAGENTA | Dmin | Dmax | Speed | Contrast |
|---|---|---|---|---|
| 101 (Comp) | 0.66 | 2.36 | 1.63 | 0.65 |
| 102 (Comp) | 0.67 | 2.40 | 1.63 | 0.64 |
| 103 (Comp) | 0.65 | 2.35 | 1.64 | 0.68 |
| 104 (Inv) | 0.65 | 2.46 | 1.64 | 0.67 |

TABLE III

| YELLOW | Dmin | Dmax | Speed | Contrast |
|---|---|---|---|---|
| 101 (Comp) | 0.70 | 2.40 | 1.67 | 0.65 |
| 102 (Comp) | 0.68 | 2.52 | 1.66 | 0.68 |
| 103 (Comp) | 0.69 | 2.47 | 1.67 | 0.67 |
| 104 (Inv) | 0.68 | 2.55 | 1.65 | 0.70 |

Tables I to III clearly show good results for Sample 104 of the present invention, having better or comparable Dmin, better Dmax, and comparable speed and contrast.

The edge affect and the acutance of Samples 101 to 104 were then evaluated according to the following procedure. A knife-edge exposure of the samples was performed through a rectangular slit obtaining rectangular exposed patches at different exposure times as showed in FIG. 1. The dimension of each patch was 0.4×10 mm. A microdensitometer was used to scan in the transversal direction each patch by reading the optical density of 400 points, starting and ending at 0.2 mm before and after the patch border, for a total scanning path of 0.8 mm as showed in FIG. 1. The scanning was repeated 20 times in the longitudinal direction as showed in FIG. 1 and the results were averaged. The result of each scanning is exemplified in FIG. 2.

Figure 2:
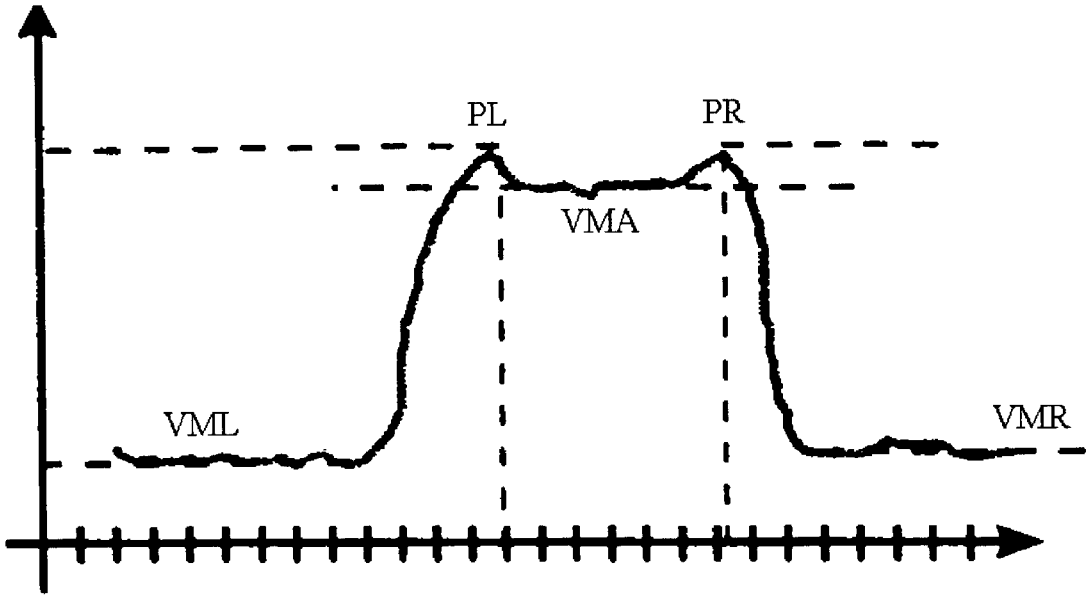

The edge effect for each exposure time was then measured according to the following formula:

$$EdgeEffect\ \% = \left(\frac{P_L - VM_A}{VM_A - VM_L} + \frac{P_R - VM_A}{VM_A - VM_R}\right) * 50$$

wherein $P_L$, $P_R$, $VM_L$, $VM_A$ and $VM_R$ represent the optical density values measured at the position reported in FIG. 1.

The acutance was measured according to the following formula:

$$Acutance = \frac{\sum_{i=1}^{50} (\Delta Di)2}{50 * \Delta D}$$

wherein ΔD is the optical density difference between PL and VML, and ΔDi is the optical density difference between two spatially adjacent points.

The results are showed in the following table IV and V.

TABLE IV

| EDGE EFFECT | 0.01 sec | 0.02 sec | 0.04 sec | 1/15 sec |
|---|---|---|---|---|
| 101 (Comp) | 5.2 | 4.8 | 4.0 | 3.3 |
| 102 (Comp) | 6.2 | 5.4 | 4.7 | 3.5 |
| 103 (Comp) | 8.1 | 7.0 | 6.0 | 4.9 |
| 104 (Inv) | 9.0 | 7.7 | 6.6 | 5.3 |

TABLE V

| ACUTANCE | 0.01 sec | 0.02 sec | 0.04 sec | 1/15 sec |
|---|---|---|---|---|
| 101 (Comp) | 27 | 25 | 23 | 21 |
| 102 (Comp) | 27 | 25.5 | 23.5 | 22 |
| 103 (Comp) | 30 | 28 | 26.5 | 24 |
| 104 (Inv) | 32 | 29 | 27 | 24.5 |

Tables IV and V clearly show the improvement Sample 104 of the present invention. The edge effect and acutance of sample 104 is always better than those of comparison samples 101–103 at any exposure time. By comparing the results of samples 101–102 with those of samples 103–104 (having the same chemical composition, but different emulsions), it is clear the synergic effect of the combination of the present invention.

The formulas of the compounds used to prepare the above mentioned samples are showed hereinbelow.

Dye 1:

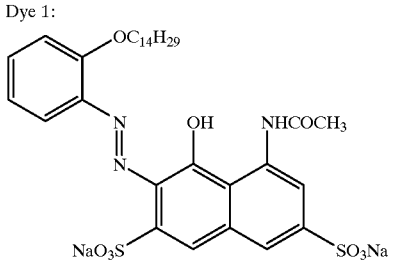

-continued
Dye 2:
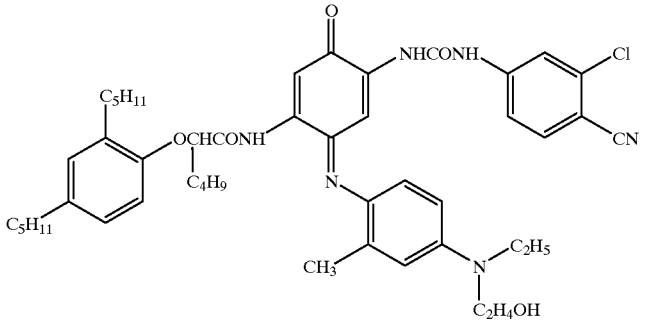
Compound 1:
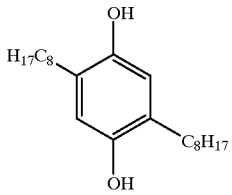
UV-1:
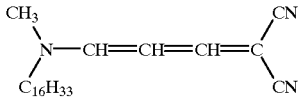
UV-2:
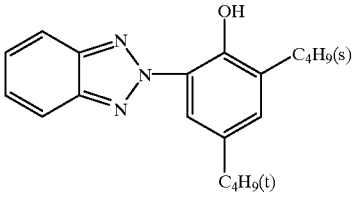
Cyan Coupler C-1:
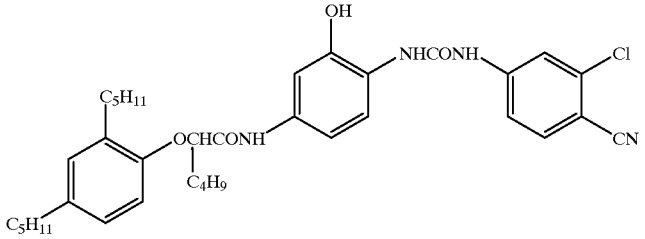
Cyan Coupler C-2:
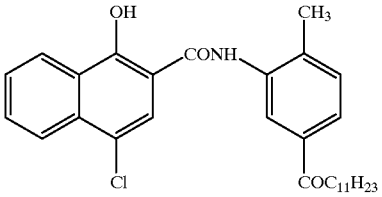
Cyan Masked Coupler CM-1:
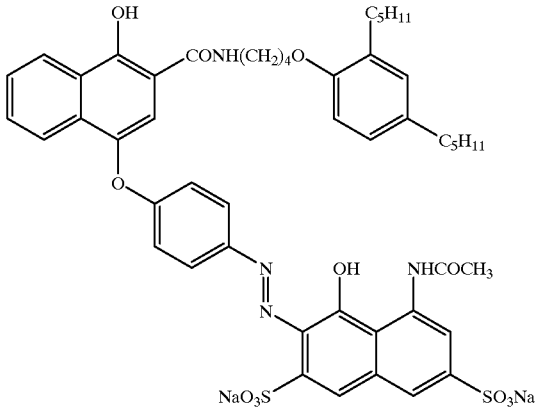

-continued
DIR Coupler D-1:
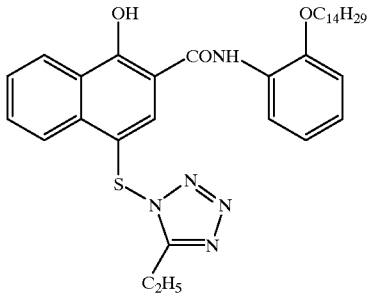
Hardener H-1:
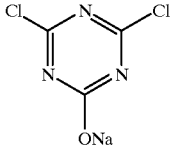
Magenta Coupler M-1:
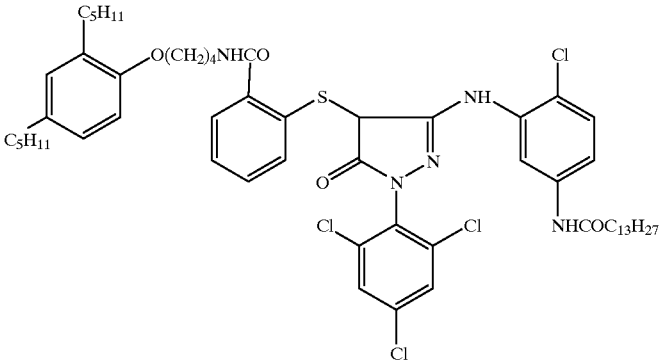
DIR Coupler D-2:
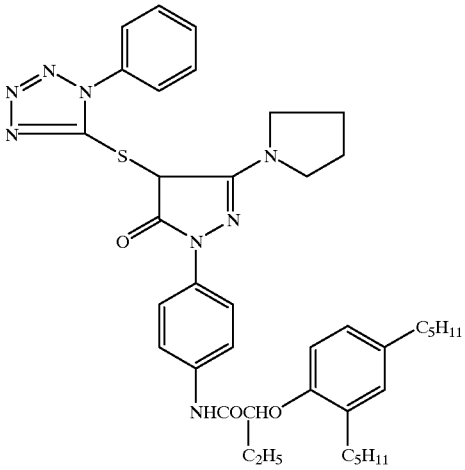
Masked Magenta Coupler MM-1:
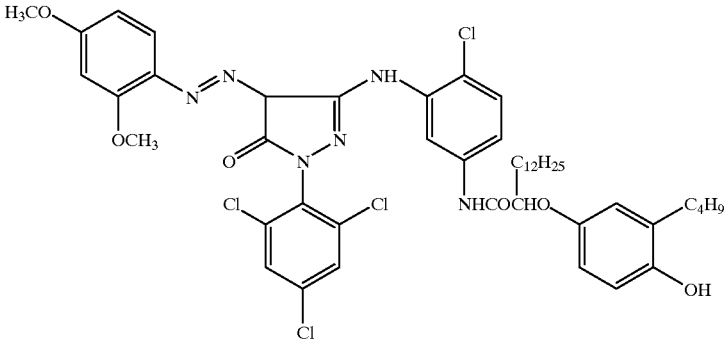

-continued
Masked Magenta Coupler MM-2:
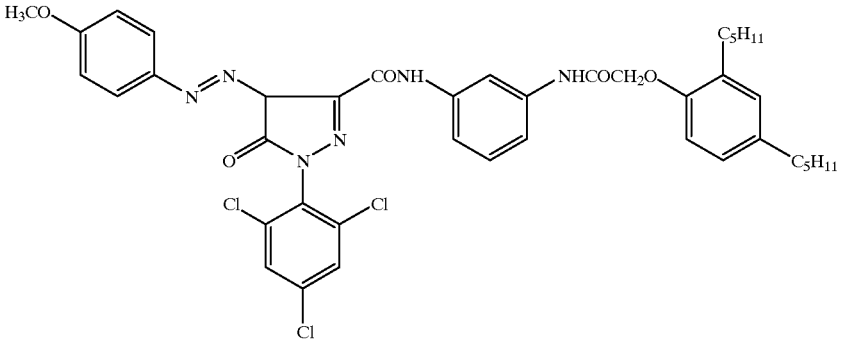
Yellow Coupler Y-1:
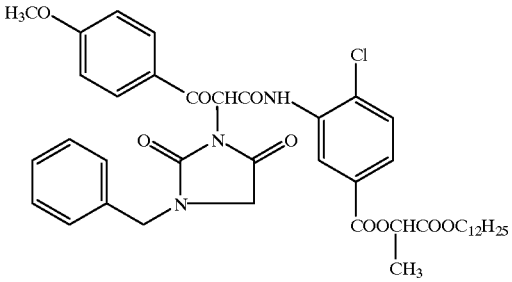
Compound-2:
$(—CH_2NHCONH_2)_2$
Hardener H-2:
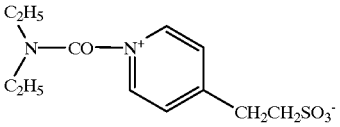
Yellow DIR Coupler Y-1:
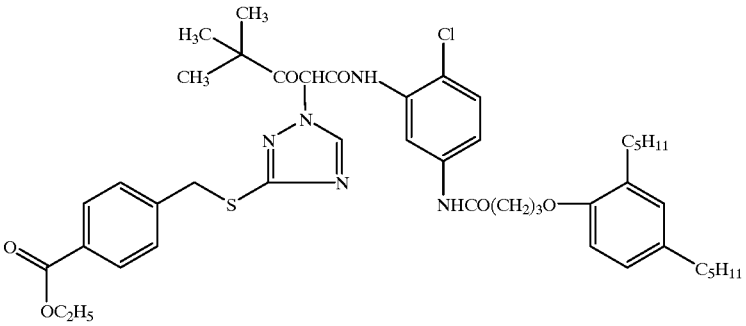
Yellow DIR Coupler Y-2
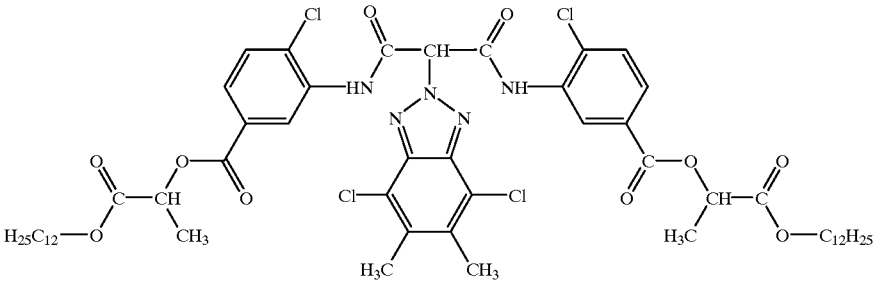

What is claimed is:

1. A light-sensitive silver halide color multiplayer photographic material comprising a support base having coated thereon:

A) at least three red-sensitive emulsion layers comprising a highest sensitivity layer, a medium sensitivity layer, and a lowest sensitivity layer, B) at least three green-sensitive emulsion layers comprising a highest sensitivity layer, a medium sensitivity layer, and a lowest sensitivity layer, C) and at least two yellow-sensitive emulsion layers comprising a highest sensitivity layer and a lowest sensitivity layer, the material characterized in that (a) a core-shell silver halide emulsion having an average silver iodide content lower than 10% is present in at least one of the lowest sensitivity red-sensitive layer, lowest sensitivity green-sensitive layer, and lowest sensitivity yellow-sensitive layers, (d) a yellow dye-forming malonodiamide DIR coupler having in the coupling position thereof a 4,7-dihalogen-2-benzotriazolyl group is present in both the medium sensitive red-sensitive emulsion layer and the medium sensitivity green-sensitive layer, and (e) a yellow dye forming DIR coupler having a 1,2,4-triazolyl group attached to a coupling position, such 1,2,4-triazolyl group comprising a hydrolizable alkoxy-carbonyl or aryloxy-carbonyl group attached to a benzylthio substituent on the 1,2,4-triazolyl group is present in at least one of the highest sensitivity red-sensitive layers and highest sensitivity green-sensitive layers.

2. The light-sensitivity silver halide color multilayer photographic material of claim 1, characterized in that said core-shell silver halide emulsion is present in all the lowest sensitive red-, green- and yellow layers.

3. The light-sensitive silver halide color multilayer photographic material of claim 1, characterized in that said core-shell silver halide emulsion comprises a silver bromo (iodide) core comprising from 0 to 3 mol % of silver iodide relative to the total silver halide content of the core phase, an intermediate silver bromoiodide shell comprising from 1 to 10 mol % of silver iodide relative to the total silver halide content of the intermediate shell phase, and an outer silver bromo(iodide) shell comprising from 0 to 3 mol % of silver iodide relative to the total silver halide content of the outer shell phase.

4. The light-sensitive silver halide color multilayer photographic material of claim 1, characterized in that said yellow dye forming malonodiamide DIR coupler is represented by the following formula (I):

(I)

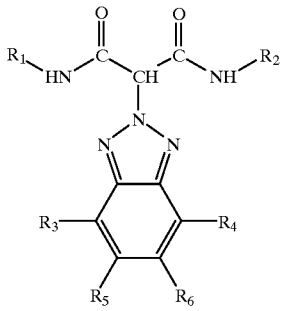

wherein $R_1$ and $R_2$, the same or different, each represent an alkyl group or an aryl group, $R_3$ and $R_4$, the same or different, each represent a halogen atom, and $R_5$ and $R_6$, the same or different, each represent a hydrogen atom, a halogen atom, an amino group, an alkyl group having from 1 to 4 carbon atoms, an alkoxy group having from 1 to 4 carbon atoms, a hydroxy group, a cyano group, an aryloxy group, an acyloxy group, an acyl group, an alkoxycarbonyl, an aryloxycarbonyl, an acylamino group, an alkylsulfonyl group, an arylsulfonyl group, an alkoxysulfonyl group, an aryloxysulfonyl or a ureido group.

5. The light-sensitive silver halide color multilayer photographic material of claim 1, characterized in that said yellow dye forming DIR coupler is represented by the following formula (II):

(II)

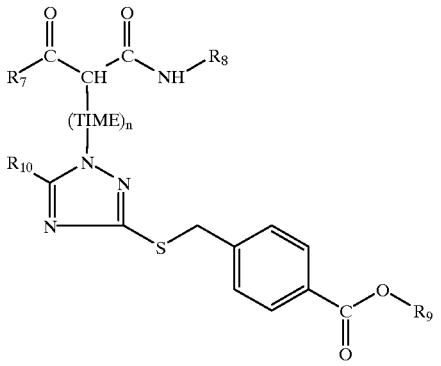

wherein $R_7$ represents an alkyl, aryl or $NHR_{11}$ group, where $R_{11}$ is an alkyl or aryl group, $R_8$ represents an alkyl or aryl group, TIME represents a timing group, $R_9$ represents an alkyl or phenyl, $R_{10}$ represents a hydrogen atom or an alkyl group, and n is 0 or 1.

* * * * *